United States Patent [19]

Roberts

[11] Patent Number: 4,730,429

[45] Date of Patent: Mar. 15, 1988

[54] VINYL WINDOW SEAL AND PROCESS

[76] Inventor: Gary W. Roberts, 19 Newport Ave., Newport News, Va. 23601

[21] Appl. No.: 943,244

[22] Filed: Dec. 18, 1986

[51] Int. Cl.[4] ..... E06B 3/30; E04G 23/02

[52] U.S. Cl. ..... 52/309.13; 52/98; 52/208; 52/395; 52/417; 52/454; 52/461; 52/514; 52/741; 52/772

[58] Field of Search ..... 52/208, 417, 514, 395, 52/98, 461, 476, 765, 766, 777, 772, 741, 465, 469, 456, 309.13

[56] References Cited

U.S. PATENT DOCUMENTS

| | | | |
|---|---|---|---|
| 261,202 | 7/1882 | Budd | 52/456 X |
| 675,311 | 5/1901 | Whipple | 52/776 |
| 1,496,916 | 6/1924 | Whittam | 52/765 X |
| 2,125,394 | 8/1938 | Neuendorf | 52/772 X |
| 3,121,977 | 2/1964 | Bersudsky | 52/417 X |
| 3,271,232 | 9/1966 | Moore | 52/776 X |
| 3,362,127 | 1/1968 | McGowan | 52/417 X |
| 3,430,394 | 3/1969 | Johnston | 49/482 |
| 3,491,584 | 1/1970 | Selzer | 52/456 X |
| 4,139,971 | 2/1979 | Kimura | 52/208 |
| 4,598,520 | 7/1986 | Ellstrom . | |
| 4,598,525 | 7/1986 | Poore | 52/208 X |

FOREIGN PATENT DOCUMENTS

| | | | |
|---|---|---|---|
| 1041219 | 10/1958 | Fed. Rep. of Germany | 52/772 |
| 1108889 | 6/1961 | Fed. Rep. of Germany | 52/469 |
| 2454863 | 5/1976 | Fed. Rep. of Germany | 52/514 |
| 2729997 | 1/1979 | Fed. Rep. of Germany | 52/469 |
| 2022670 | 12/1979 | United Kingdom | 52/776 |

*Primary Examiner*—Alfred C. Perham
*Attorney, Agent, or Firm*—Wallace J. Nelson

[57] ABSTRACT

A window construction is disclosed wherein a unitary vinyl seal 36, corresponding in shape to the window sash 20 and frame 18, is employed to seal the translucent panes 28, 30, 31, etc., in position. Double-backed adhesive foam tape strips 38, 40, 42, 44, 45, 46, etc., serve to sealingly bond vinyl seal 36, 36*a,* and 66 to the translucent panes, the associated sash 20 and frame 18 structure. Replacement of broken panes involves cutting around the periphery of the broken pane (FIGS. 6 and 7), removing the cut segment, installing a replacement pane and sealing it in position. The same segment of vinyl seal 36 removed, or a new seal 66 cut or formed to the same dimensions as the segment cut away, is employed to seal the replacement pane 28*a* in position. Sealing of the new seal (FIG. 7) is accomplished by an essentially triangular strip of adhesive foam tape 68 having adhesive on all surfaces thereof. Similar replacement seals can also be formed from the embodiments illustrated in FIGS. 2–5 with the same tape forms illustrated therein being employed to seal the replacement seal segment.

9 Claims, 7 Drawing Figures

VINYL WINDOW SEAL AND PROCESS

FIELD OF THE INVENTION

This invention relates to window construction and relates in particularly to the construction of window units wherein the need for putty or glazing compounds is eliminated.

BACKGROUND OF THE INVENTION

The standard process presently employed in the manufacture of windows used by the building trade, home construction, and the like, is to provide a peripheral wooden frame, attach a wooden sash within this frame, position one or more panes of glass onto this sash, fix the individual glass panes to the sash via a plurality of triangular metal points inserted into the sash while abutting spaced peripheral areas of the individual glass, and applying putty or other glazing compound around the peripheral edge of the individual glass panes to seal the panes to the frame and sash. This is a time consuming process and requires considerable skill by the workmen to obtain consistent and reliable results. Further, after installation of the windows in a building they must be painted to obtain the desired decor. Accordingly, there is a definite need in the art for improved window unit construction and the process for obtaining such construction.

It is therefore an object of the present invention to provide improved window construction wherein the use of putty or glazing and painting is eliminated.

It is another object of the present invention to provide a window construction process that can be accomplished by semi-skilled workmen.

A further object of the present invention is an improved multi-pane window unit.

Another object of the present invention is a novel process for constructing window units.

A further object of the present invention is a novel process of replacing individual broken panes in a multi-pane window unit.

SUMMARY OF THE INVENTION

According the present invention, the foregoing and additional objects are attained by providing a peripheral window frame, attaching a lattice sash within the peripheral frame to divide the area enclosed therein into the desired number of openings, positioning an individual translucent pane in each opening so as to be supported by portions of the sash and peripheral frame, securing the individual panes in position by use of triangular points, or the like, inserted into the sash and frame at selected spaced locations about the periphery of the individual panes, and attaching a unitary vinyl plastic seal to the individual panes, the sash, and the peripheral frame to provide a moisture proof assembly. Pigmentation of the desired shade may be incorporated within the vinyl seal structure and thereby blend the finished product into the desired decor.

BRIEF DESCRIPTION OF THE DRAWINGS

A more complete appreciation of the invention and many of the attendant advantages thereof will be readily apparent as the same becomes better understood by reference to the following more detailed description when considered in connection with the accompanying drawings, wherein.

DETAILED DESCRIPTION OF THE PREFERRED EMBODIMENTS

Figure 1:
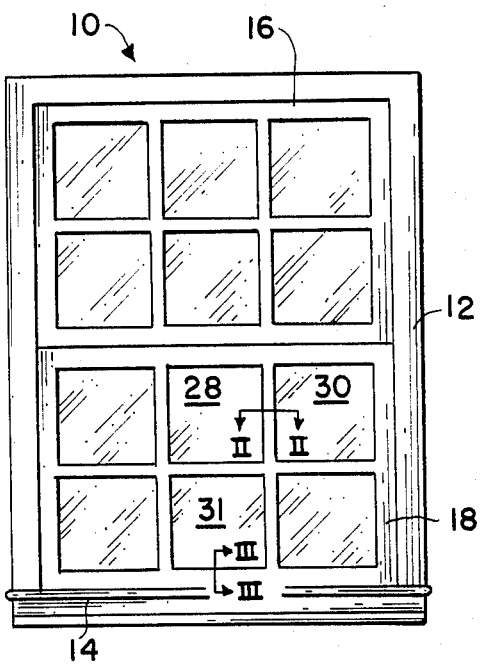
FIG. 1 is a view of a typical window assembly containing window units constructed in accordance with the present invention.

Referring now to the drawing, and more particularly to FIG. 1, there is shown a window assembly, according to the present invention, as viewed from the inside of a house, and generally designated by reference numeral 10. Window assembly 10, as shown in the illustration, includes a frame 12 and a sill 14. In the illustrated embodiment, two window units 16 and 18 are housed within frame 12 in a vertically slidable relationship. This illustrated embodiment is referred to in the trade as a 6×6 structure, i.e. six individual translucent panes are contained within each vertical unit. It is to be understood that the described embodiment is for the purposes of illustration only and that the invention is equally applicable to 4×4, 2×2 or any closure construction employing at least one individual translucent pane. Also, although the illustrated embodiment is for vertically slidable units, the invention is equally applicable to casement, horizontally slidable, tiltable and fixed or non-movable closure window units for a structure.

As used herein the term "window" is also intended to include doors having at least one translucent pane, as for example, French-style doors.

Also, as used herein, the term "translucent pane" is intended to refer to any pane material having any capability for the conveyance of light through the material, and the term is intended to include glass or plastic mediums ranging from fully transparent or clear materials to substantially light-dispersing or reflective materials.

Figure 2:
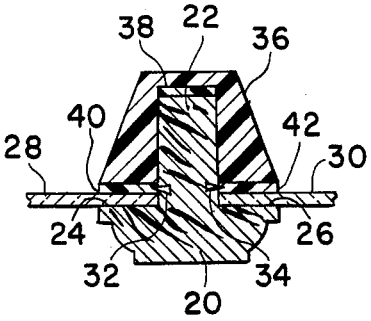
FIG. 2 is a cross-sectional view of a portion of one of the window units shown in FIG. 1 as taken along line II—II of FIG. 1.

Referring now to FIG. 2, a section of an individual window unit 18 is shown and includes lattice sash 20 having an ornamental interior area with a center rectangular tongue 22 extending therefrom. A pair of shoulders 24, 26 are formed on the ornamental portion of sash 20 at the junction thereof with tongue 22. Shoulders 24, 26, serve to support a peripheral edge of individual translucent panes 28, 30. Panes 28 and 30 are initially retained in abutting contact with shoulders 24, 26 by a plurality of metal triangular points, two of which are shown and designated by reference numerals 32, 34. These points 32, 34, penetrate into the surface of tongue 22 and are disposed in abutting engagement with, and spaced along the peripheral edge of, the individual panes 28, 30.

A unitary vinyl plastic seal unit 36, is disposed over tongue 22 and is sealed thereto via a flexible double-backed adhesive foam strip of tape 38. The unitary construction of vinyl seal 36 is obtained by conventional manufacturing techniques and may include bonding of individual vinyl strips, extrusion molding, form molding, and the like. As illustrated in FIG. 2, vinyl seal 36, in section, has a flat base and two tapered edges extending therefrom to flat ends and is, thus, essentially in the shape of a solid inverted "V" having a flat base and flat ended points. In the embodiment shown in FIG. 2 vinyl seal 36 is of solid cross-sectional configuration, save for a central groove formed therein. This groove is of an open-ended rectangular configuration of essentially the same size as tongue 22 formed on sash 20. Tongue 22 tightly fits into this groove when vinyl seal 36 is positioned as shown in FIG. 2. A strip of flexible double-backed adhesive foam tape 38 is disposed between the groove formed in seal 36 and the tip of tongue 22 to sealingly join these two elements. Additional strips of double-backed tape 40, 42 join the flat V-tips of vinyl seal 36 to respective translucent panes 28 and 30 to thereby seal translucent panes 28 and 30 within the window unit 18. Additional strips of similar tape (not shown) may be employed along the other surfaces of tongue 22 to engage with the groove in seal 36, when desired.

Figure 3:
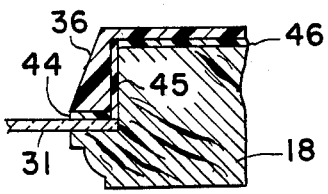
FIG. 3 is a cross-sectional view of one of the window units shown in FIG. 1 as taken along line III—III of FIG. 1.

Referring now to FIG. 3, the edge portion of vinyl seal 36 that overlaps and covers the peripheral frame of window unit 18 is shown. A strip of the flexible double-backed adhesive foam tape 44 serves to attach and seal this portion of vinyl seal 36 to translucent pane 31 while an additional strip or strips of double-backed tape 45 and 46 secure the over-lapping lip portion of vinyl seal 36 to completely cover the face of the peripheral frame of unit 18. In some instances, tape strips 44, 45 and 46 may be formed of one wide strip that may be attached to frame 18 prior to positioning seal 36 thereon.

Figure 4:
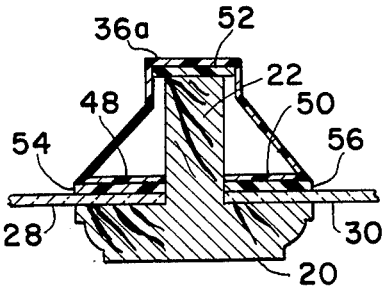
FIG. 4 is a view similar to FIG. 2 showing a modified form of the invention.

Referring now to FIG. 4, a modification of the seal shown in FIG. 2 is illustrated. As shown therein, vinyl seal **36*a* is of essentially hollow cross-sectional area and is provided with a pair of inwardly extending ears 48, 50 with the termini thereof abutting tongue 22 of sash 20. Three strips of flexible double-backed adhesive foam tape, designated respectively, by reference numerals 52, 54, and 56, are positioned between the interior of vinyl seal 36*a* and respective surfaces of tongue 22 and translucent panes 28, 30**.

Figure 5:
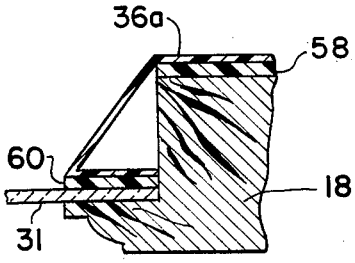
FIG. 5 is a view similar to FIG. 3 showing the same modification as illustrated in FIG. 4.

Referring now to FIG. 5, vinyl seal **36*a* is secured to the face of the peripheral frame of unit 18 by a strip of flexible double-backed adhesive foam tape 58 and to translucent pane 31 by a similar strip of tape 60**.

Figure 6:
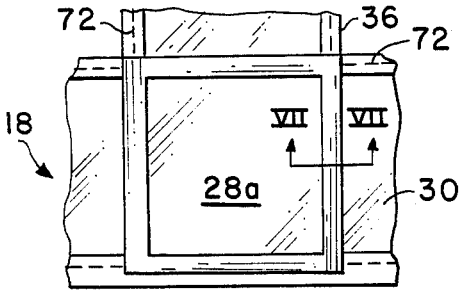
FIG. 6 is a partial view similar to the reverse side of FIG. 1 and illustrating how this area appears when the present invention is employed to replace a single broken pane of the window unit shown in FIG. 1; and, FIG. 7 is a view of the replaced pane area as taken along line VII—VII of FIG. 6, and illustrating another modified form of the seal of the present invention.
Figure 7:
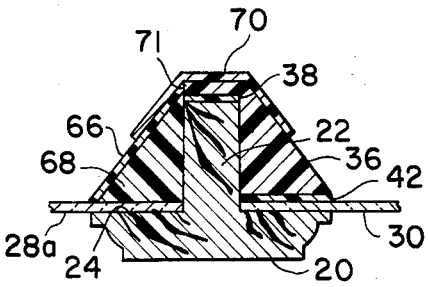

Referring now more particularly to FIG. 6 and 7, a further modification and replacement of a broken pane in a window unit 18 according to the present invention will be described. The entire area surrounding the broken pane area is cleaned of the retention structure and the broken pieces of the glass removed. For example, assuming pane 28, shown in FIG. 2 is broken, the entire area between the tongue segments 22 on all four peripheral edges of pane 28 must be cleared to remove the broken pieces of the pane. This would be accomplished in the illustrated embodiment by using a utility knife, or the like, to cut through vinyl seal 36 at substantially the edge of the longitudinal surface of tongue 22 contacting all four edges of the broken pane. The four-sided segment, thus cut, is stripped away from window unit 18 to expose shoulder 24 and three additional shoulders (not shown) formed on sash 20. The four-sided segment stripped from window unit 18 may then be cleaned of any remaining tape or debris and used, along with new strips of tape to seal replacement pane **28*a* within window unit 18**.

Alternatively, a replacement vinyl seal 66 (FIG. 7), custom formed for this particular size area, may be employed to replace broken pane 28 with a new pane **28*a*. Replacement vinyl seal 66 may be provided in kit form or may be cut from a spare vinyl seal unit. As shown in FIG. 7, the illustrated replacement seal 66 is a modification of seal 36 and seal 36*a*. In this embodiment, seal 66, in section, is an essentially linear strip that is secured to tongue 22 and replacement pane 28*a* via a wedge or essentially triangular strip of flexible foam tape 68 that is provided with an adhesive coating on all surfaces thereof. New pane 28*a* is affixed against shoulder 24 (and the other shoulders not shown), as in the original construction, and replacement vinyl seal 66 sealed thereto via a strip of flexible adhesive foam tape 68**.

Kits of this type may come assembled or unassembled with final fitting, trimming and assembly being performed by the individual replacing the pane. When assembled on-site, the individual pieces would be sealed at the joints using conventional RTV or other vinyl adhesive.

To further assure the seal of the replacement unit, a strip of vinyl tape 70 is attached over at least the mating surfaces 71 of replacement vinyl seal unit 66 along the edges thereof that abut original vinyl seal 36. Prior to applying tape 70, the mating surfaces 71 may be sealed by applying a RTV or other conventional vinyl sealant adhesive over these surfaces. Also, suitable indicia, for example, a faint solid or dotted pigmented line 72 may be provided on the exterior of vinyl seal 36 to assist in locating the area that must be cut out for replacement of a broken pane.

Although the embodiment illustrated in FIG. 7 differs from those shown in FIGS. 2 and 4, it is to be understood that kits of each embodiment are considered within the scope of the invention.

In some instances it may be desirable to replace various panes in a window unit that are not broken. This situation could occur when it is desired to change the transparency of a window unit. The same procedure, as described above, would stil be applicable.

Also, although the replacement procedure has been specifically described relative to windows manufactured by the present invention, the same procedure could be employed in replacing conventionally manufactured windows and thereby eliminate the need for putty or other glazing compound when making such replacements. In this instance, all the putty or other glazing compound, and the pane portions secured thereby, would be removed and a replacement vinyl seal 66 used to maintain the replacement pane in position within the window, as described above. When the existing putty or glazing compound appears sound and removal thereof is not desired, a suitable vinyl seal 66 could be employed over the putty or glaze with a strip of double-backed adhesive foam tape serving to secure the seal directly to the putty or glaze.

Suitable replacement kits may also be provided utilizing the flexible double-backed adhesive foam tape on both sides of the peripheral edges of replacement pane **28*a* to provide sealing contact thereof with shoulder 24. In this situation conventional paper or other protective backing would be provided for the tape surface to be placed against shoulder 24** until ready for assembly.

Such backing is conventional in the art and would be used in all embodiments of the present invention until the tape is to be applied to the desired surface.

The triangular metal points 32, 34 described herein to initially retain the individual panes within sash 20 may also be eliminated and this function performed by a suitable adhesive, dots of glue, peripheral strips of flexible double backed adhesive foam tape, or the like.

The flexible double-backed adhesive foam tape described herein may be any suitable rubber or synthetic polymeric material that provides sufficient tack or adherent properties, in the temperature range to which the window is to be exposed, to maintain an adequate seal for the pane, frame and vinyl seal members employed.

Also, moisture resistant sealants or adhesive layers may be employed in addition to or in lieu of some of the flexible double-backed adhesive tape applications described herein without departing from the spirit or scope of the invention.

Although the invention has been described relative to a specific vinyl plastic material, it is not so limited and the use of any suitable plastic, polymeric or lightweight metallic material, such as aluminum and its alloys are considered useful in practice of the present invention. The essential criteria for any such material is that, although the material employed may be pliable, it must be of sufficient strength and rigidity to perform the seal and support functions required in the temperature range contemplated for use of the window units fabricated thereby. A thin gauge of polyvinyl chloride type siding that is presently used in the home construction and repair industry is a specific example of suitable vinyl plastic material useful in the practice of the present invention. It is well known in the art to employ various additives to polyvinyl chloride to vary the properties thereof and the addition of such additives to provide mildew resistance and to vary and obtain other desired material properties of the polyvinyl chloride are considered within the scope of the invention.

There are obviously many modifications and variations of the present invention readily apparent to those skilled in the art in the light of the above teachings. It is therefore to be understood that within the scope of the appended claims the invention may be practiced otherwise than as specifically described.

What is claimed as new and desired to be secured by Letters Patent of the United States is:

1. A window unit comprising:

(a) a peripheral frame, (b) a sash contained within said peripheral frame and, combined with said peripheral frame, serving to divide the area within said peripheral frame into at least two open areas;

(c) an individual translucent pane disposed within each opening formed by said sash and said frame;

each said pane having the periphery thereof engaging and supported by portions of said sash;

said peripheral frame and said sash being of wooden construction, said sash having an ornamental interior area and a center rectangular tongue having a base and a tip and extending from said ornamental sash area, a pair of shoulders formed on said ornamental sash area and forming the portions of said sash engaged by and supporting each said translucent pane, (d) a unitary vinyl support member sealing and retaining each said translucent pane within said sash and having surfaces thereon mating with and overlaying the center rectangular tongue of said sash and portions of said peripheral frame;

(e) sealing means interposed between said unitary vinyl support member and the tip of said center rectangular tongue of said sash and serving to seal said unitary vinyl support member to said sash, and, (f) additional sealing means interposed between portions of said peripheral frame and the portions of said unitary vinyl support member overlaying said peripheral frame and serving to seal said unitary vinyl support member to said peripheral frame along a vertical and a horizontal surface of said peripheral frame.

2. The window unit of claim 1 including:

both said sealing means and said additional sealing means being flexible tape strips having adhesive on all surfaces thereof so as to form a sealing bond with glass, wood and vinyl surfaces.

3. The window unit of claim 1 including:

said unitary vinyl support member surfaces mating with and overlaying the center rectangular tongue portions of said sash having an external cross-sectional area essentially in the shape of a flat tipped "V" and an open internal cross-sectional area essentially in the shape of an open ended rectangle;

both said sealing means and said additional sealing means being flexible double-backed adhesive foam tape strips having adhesive on all surfaces thereof so as to form a sealing bond with glass, wood and vinyl surfaces.

4. The window unit of claim 3 wherein the tips of said inverted "V" terminate in inwardly extending ears that are disposed horizontal relative to said flat base and provided with termini that abut against said center rectangular tongue of said sash and a strip of flexible double-backed adhesive foam tape serves to secure said ears to the periphery of one of said individual translucent panes.

5. A closure for an opening in a structure comprising:

a peripheral frame having at least one through opening therein;

a sash contained within said at least one through opening of said frame;

said sash combined with said peripheral frame, serving to divide the said at least one opening within said peripheral frame into at least two open areas;

a translucent pane disposed within each opening formed by said sash and said frame;

said peripheral frame and said sash being of wooden construction, said sash having an ornamental interior area and a center rectangular tongue extending from said ornamental sash area, a pair of shoulders formed on said ornamental sash area and forming the portions of said sash engaged by and supporting each said translucent pane;

vinyl support means sealing each said translucent pane along peripheral portions thereof to a vertical and a horizontal area of said peripheral frame;

said vinyl support means being a unitary vinyl seal overlaying the center rectangular tongue portions of said sash;

sealing means sealing said unitary vinyl seal to each said translucent pane along peripheral portions thereof to said sash; and, said sealing means being flexible tape strips having adhesive on all surfaces thereof and serving to seal said unitary vinyl seal member to each translucent pane, said peripheral frame and said sash.

6. The method of replacing an individual broken or unbroken translucent pane disposed in a lattice sash of a multi-pane window structure comprising the steps of:

(a) removing any material securing the pane to be replaced from the lattice sash of the window structure;

(b) completely removing the pane from the sash;

(c) inserting a replacement translucent pane in the sash position previously occupied by the removed pane;

(d) securing the replacement pane in fixed position within the lattice sash of the window structure with a unitary vinyl seal;

(e) employing a flexible double-backed adhesive foam tape to engage both the replacement pane along the periphery thereof and the unitary vinyl seal; and, (f) applying a strip of vinyl tape along the peripheral of the unitary vinyl seal to further effect sealing of the replacement pane.

7. The method of claim 6 wherein the translucent pane removed is initially maintained in position within the sash by a first unitary vinyl seal that also serves to secure the remaining panes in the lattice sash and wherein the step of removing any material securing the pane from the lattice sash includes the step of cutting the first unitary vinyl seal along the periphery of the translucent pane that is to be removed so as to separate a segment of the first vinyl seal from the remainder of the seal, and the step of securing the replacement pane in fixed position utilizes a second unitary vinyl seal of the same dimensions as the segment removed with the replaced pane.

8. The method of claim 6 wherein the translucent pane removed is initially maintained in position within the sash by a unitary vinyl seal that also serves to secure the remaining panes in the lattice sash and wherein the step of removing any material securing the pane from the lattice sash further includes, the step of cutting the unitary vinyl seal along the periphery of the translucent pane that is to be removed so as to separate a segment of the vinyl seal from the remainder of the seal and removing the cut segment from the remainder of the seal, and the step of securing the replacement pane includes, using the cut and separated segment of the first unitary vinyl seal to secure the replacement pane in position.

9. The method of claim 6 wherein the unitary vinyl seal is formed of individual strips of vinyl material fitted and bonded together at the site of replacement of the translucent pane.

* * * * *